United States Patent [19]

Hakim

[11] Patent Number: 4,776,184

[45] Date of Patent: Oct. 11, 1988

[54] COMPOSITE JEWELRY

[76] Inventor: Fereidoun Hakim, 55 Forest Row, Great Neck, N.Y. 11024

[21] Appl. No.: 68,664

[22] Filed: Jul. 1, 1987

[51] Int. Cl.[4] ..... A44C 1/00

[52] U.S. Cl. ..... 63/20; 63/12; 63/29.1

[58] Field of Search ..... 63/29 R, 20, 28

[56] References Cited

U.S. PATENT DOCUMENTS

| | | | |
|---|---|---|---|
| 758,848 | 5/1904 | Pejchar | 63/29 R |
| 1,045,106 | 11/1912 | Mayer | 63/29 R |
| 1,056,414 | 3/1913 | Hexter | 63/29 R |
| 3,443,398 | 5/1969 | King | 63/13 |
| 3,605,438 | 9/1971 | Chalson | 63/29 R |

*Primary Examiner*—Richard J. Johnson

*Attorney, Agent, or Firm*—Auslander & Thomas

[57] ABSTRACT

A composite jewelry article is made from a selection of radial armed pieces which are stackable and joinable with a pin stud. The pieces offer an interchangeability of different parts to assemble infinite design combinations.

2 Claims, 1 Drawing Sheet

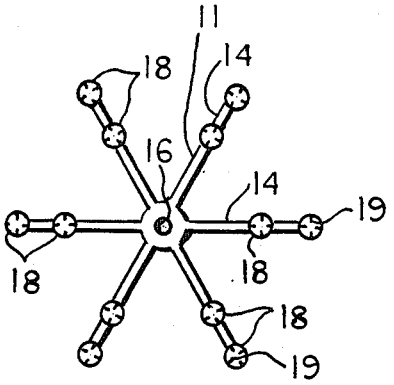
FIG.1
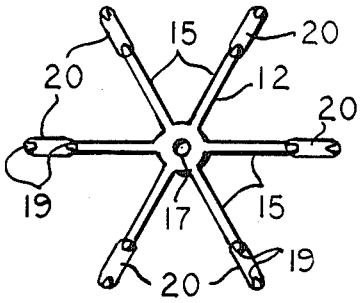
FIG.2
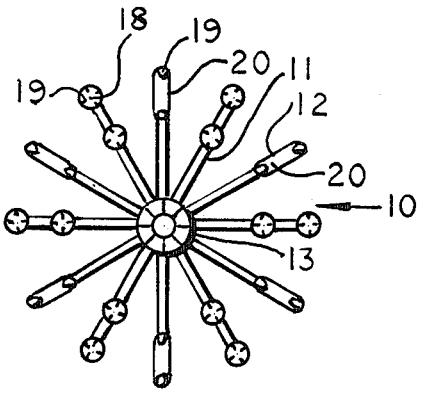
FIG.4
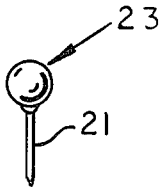
FIG.3
FIG.5
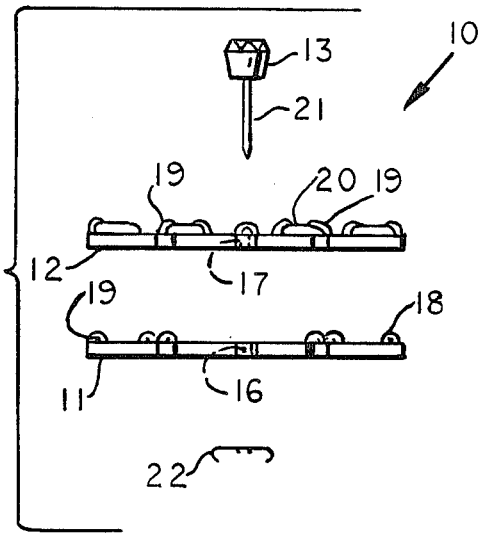

COMPOSITE JEWELRY

BACKGROUND OF THE INVENTION

The present invention relates to a composite jewelry article, and more particularly, to a composite jewelry article comprising a selectable stud and a selection of radial armed pieces, mountable on the stud, superposed upon each other creating a unitary article of jewelry. The composite jewelry of the present invention can be in the form or an earring, a tie tack or a pin, for instance.

The present invention opens new vistas for jewelry marketing. The jeweler provides a selection of studs and jackets from which the purchaser may then select and create a personalized composite article of jewelry. The purchaser may select an assortment of studs and jackets and create new articles for wear from the selection, or select a single combination and use that continually.

The radial arms of the jackets provide a platform for an infinite variety of stones or gems. The stones or gems mounted on the arms elevate the surface of the arms so that stacked jacket arms substantially maintain their position between the arms of the jacket upon which they are stacked. The stud holds the jackets firmly together. The stud may be tightened against the jackets by a conventional screw closure or clip.

U.S. Pat. No. 3,605,438 discloses a pin device or a stud that can be used to hold an assortment of jewelry findings in stacked relationship. Position is maintained in one embodiment by interrelating dimples and cups in the plate-like elements of the device. In other embodiments, small supplemental throughpins achieve the positioning effect. In all of these embodiments, special additional structure must be provided, in addition to the decorative structure to maintain position.

U.S. Pat. No. 3,968,661 discloses the conventional stacking of jewelry parts held together with a conventional press-fit pin and stud. The parts in the stack are rotatable and make no provision for being held in substantially fixed position.

U.S. Pat. Nos. 2,610,487 and 2,433,711 are typical prior art references for variable jewelry, where changes or substitutions can be made to vary the standard jewelry unit. The systems are complex, and do not assemble, based upon an assemblage of simple but variable prototypes.

U.S. Pat. Nos. 3,613,393, 2,733,578, 2,682,759, 2,190,778 and 915,678 are typical of complex prior art efforts to provide various forms of variable jewelry.

Accordingly, a primary object of the present invention is to provide a composite jewelry article. comprising a selection of prototypical components, including a selected stud and a selection of stackable radial armed jackets having decorative stones or gems which may be precious or semiprecious.

Another object of the present invention is to provide a selection of jewelry jackets with mounted stones or gems which substantially nonrotatively stack on a stud.

Another object of the present invention is to provide a jewelry jacket with radial arms adapted to stack with other jewelry jackets with radial arms, which lie between the radial arms of the lower stacked jacket.

Another object of the present invention is to provide an infinitely variable composite jewelry piece adapted to selectively function as an earring, a tie tack or a pin.

Another object of the present invention is to provide a radial armed jewelry jacket for a composite jewelry piece adapted to hold a selected stone, or stones or gems, on the radial arms.

Another object of the present invention is to provide a stud for a composite jewelry piece adapted to hold a selected stone or gem.

A BRIEF SUMMARY OF THE INVENTION

According to the present invention, a composite piece of jewelry is provided, assembleable from a selection of studs and a selection of jackets with radial arms having mounted stones or gems. The jackets are spindled on the stud. The composite piece of jewelry serves as a pin, an earring or a tie tack.

A composite article of jewelry comprising a jacket, including radial arms and an opening in the body of the jacket, in combination with at least one other jacket including radial arms, is joined by a fastener. The fastener includes a pin which passes through the body opening in the jacket. The jackets are thereby fastened as a composite unit.

More than one jacket may be joined through openings in their bodies. The fastener may be a stud which includes a pin. The pin may interact with a closure such as a clip or a screw. The radial arm may include decorations such as gems or stones which may be precious or semiprecious.

In another embodiment, the composite article has more than one jacket with radial arms and openings in the body of the jackets. The jackets are joined by a fastener. The fastener includes a pin, usually on a stud. The pin passes through the body openings in the jackets to join them as a composite unit.

Although such novel feature or features believed to be characteristic of the invention are pointed out in the claims, the invention and the manner in which it may be carried out, may be further understood by reference to the description following and the accompanying drawings.

Referring now to the figures in greater detail, where like reference numbers denote like parts in the various figures.

BRIEF DESCRIPTION OF THE DRAWING

FIG. 1 is a plan view of a radial armed jacket of the present invention with a particular double stone configuration.

FIG. 2 is a plan view of a radial armed jacket of the present invention with a particular single stone configuration.

FIG. 3 is an elevation of a pearl stud usable with the present invention.

FIG. 4 is a plan view of an embodiment of the composite jewelry of the present invention with the jackets of FIGS. 1 and 2 superposed and engaged on a faceted stud.

FIG. 5 is an exploded elevation of the composite jewelry of FIG. 4.

Referring now to the figures in greater detail, where like reference numbers denote like parts in the various figures.

DETAILED DESCRIPTION

The composite jewelry article 10 as shown in FIGS. 4 and 5 is an assembly of the jacket 11 of FIG. 1 and the jacket 12 of FIG. 2 in combination with the stud 13 with the faceted stone as shown in FIGS. 4 and 5.

The jacket 11, as shown in FIG. 1, includes radial arms 14 and an opening 16. The radial arms 14 are each mounted with two stones 18. The stones 18 are mounted with conventional prongs 19. The jacket 12, as shown in FIG. 2, includes radial arms 15 and an opening 17. The jacket 12 includes radial arms 15 with one stone 20 mounted with conventional prongs 19. The jackets 11 and 12 are spindled on the pin 21 of the stud 13, as shown exploded away in FIG. 5. The pin 21 holds the jackets 11 and 12 together with a clip 22. FIG. 4 is a plan view of the composite jewelry article 10 of FIG. 5, as held together on the stud 13.

In FIG. 3 an alternate stud 23, having a pearl, as shown by way of example.

In use, the composite jewelry article 10 is assembleable from a selection of jackets and studs with a variety of selected stones or ornaments. The pins on the studs may use the conventional clip 22, as shown, or may have a screw fitting, for instance. The configuration of the radial arms 14 and 15 assist in displaying the various selected patterns of design for an almost unlimited selection of designs, including a selection of stud combinations. The variation available are both in shapes and color and combinations of shapes and colors.

The user can select a different assortment of jackets and studs for each use, or once having selected the initial combination, can reuse the combination for all occasions. The composite jewelry article 10 can function as an earring, a pin or a tie tack.

The grasp of the stud on the jackets comfortably holds the jackets together. The upward projection of the stones maintains the jackets against rotation once assembled.

For a jeweler, the present invention offers the business opportunity of being able to offer a greater variety of designs, and the opportunity to sell more components than the usual jewel pieces offered in the prior art. From the point of view of the purchaser, the present invention offers a greater selection of available designs and the opportunity to select a personalized design.

The terms and expressions which are employed are used as terms of description; it is recognized, though, that various modifications are possible.

It is also understood the following claims are intended to cover all of the generic and specific features of the invention herein described; and all statements of the scope of the invention which as a matter of language, might fall therebetween.

Having described certain forms of the invention in some detail, what is claimed is:

1. A composite article of jewelry comprising a first radial armed piece, said first radial armed piece including a plurality of radial arms and a central opening in its body, in combination with at least one radial armed piece including at least a plurality of radial arms and a central opening in its body, at least most said radial arms including at least one stone toward their ends on an upper surface, and fastening means, said fastening means including a pin; a stud; and a closure, said pin adapted to pass through said central body openings in said radial armed pieces, whereby said radial armed pieces are fastened substantially against rotation as a composite unit.

2. The invention of claim 1 wherein said closure is a clip.

* * * * *